US006357371B1

(12) United States Patent
Moll et al.

(10) Patent No.: US 6,357,371 B1
(45) Date of Patent: Mar. 19, 2002

(54) METHOD AND DEVICE FOR PRODUCING SEAMS

(75) Inventors: Klaus-Uwe Moll, Apweilerstrasse 27, D-52511 Geilenkirchen; Burkhard Wulfhorst, Aachen, both of (DE)

(73) Assignee: Klaus-Uwe Moll, Geilenkirchen (DE)

( * ) Notice: Subject to any disclaimer, the term of this patent is extended or adjusted under 35 U.S.C. 154(b) by 0 days.

(21) Appl. No.: 09/647,485

(22) PCT Filed: Mar. 20, 1999

(86) PCT No.: PCT/DE99/00797

§ 371 Date: Dec. 7, 2000

§ 102(e) Date: Dec. 7, 2000

(87) PCT Pub. No.: WO99/50492

PCT Pub. Date: Oct. 7, 1999

(30) Foreign Application Priority Data

Mar. 28, 1998 (DE) ..... 198 13 887

(51) Int. Cl.[7] ..... D05B 3/00

(52) U.S. Cl. ..... 112/475.17; 112/165

(58) Field of Search ..... 112/475.17, 165, 112/167, 163

(56) References Cited

U.S. PATENT DOCUMENTS 2,058,271 A * 10/1936 Taubert ..... 112/165
2,369,183 A * 2/1945 Sigoda ..... 112/165
2,491,457 A * 12/1949 Sigoda ..... 112/165

* cited by examiner

*Primary Examiner*—Ismael Izaguirre
(74) *Attorney, Agent, or Firm*—Herbert Dubno

(57) ABSTRACT

The invention relates to a method for producing sewn seams and a device for carrying out the method. The invention includes two sewing needles of which all moving parts are situated only on one side of the textile. Two or more sewing needles move obliquely and alternately penetrate the entire sewing material. The loop formed by a sewing thread is taken up by the next penetrating needle. The following penetrating needle then transfers the loops of the sewing thread. The sewing needles move three-dimensionally. The method and device are suitable for sewing large, curved material that should not be creased, for example, reinforcement fabric for fiber reinforced materials.

8 Claims, 3 Drawing Sheets

METHOD AND DEVICE FOR PRODUCING SEAMS

CROSS REFERENCE TO RELATED APPLICATIONS

This application is a national phase of PCT/DE99/00797 filed Mar. 20, 1999 and based upon German national application 198 13 887.3 filed Mar. 20, 1999 under the International Convention.

FIELD OF THE INVENTION

The invention relates to a method to produce sewn seams and also includes a device to carry out these methods. The sewn seam consists of two or more sewing threads and it is produced by guiding the loop of one thread through the loop of another thread.

The invention also includes a sewing machine with two needles of which all moving parts are situated only on one side of the textile as well as a special support unit for the textile. Besides the sewing machine and the support unit for the textile the invention includes a control unit.

Conventional sewing machines produce sewn seams in which one sewing thread or more sewing threads are tied with themselves or with each other. The known stitch types are classified and described in DIN 61 400. All devices for the production of the there described stitch types which demand a full penetration of the textile have in common that mechanically coupled machine parts are situated above and below the plane of the textile. The mechanical coupling units are situated in a machine-stand. Typical machine-stands have a C-shape. The processing of flat textiles which cannot or should not be folded is therefore only in small dimensions possible. It is not possible to process flat textiles of big dimensions or textiles which are tube-shaped or sleeve-shaped. Conventional methods which make use of a mechanical decoupling and an electronic coupling of the machine parts above and below the plane of the textile are working under the prerequisites that the sewing machine moves in a linear direction and the textile moves on a plane. This makes necessary that the space for sewing machine is always at least two times, in many cases four times as big as the area of the textile if all areas of the textile should be sewn.

The sewing of spherically shaped textiles or of textiles which have to be fixed spherically before sewing is not possible with the known sewing machines. One method which is in public erroneous named as a sewing method introduces a loop of a thread into a textile making use of a hollow needle. The loop is introduced from the upper side of the textile. It does not penetrate the textile completely and it is not tied with itself or another thread on the bottom side of the textile. The thereby produced seam is not a real connection as the single layers of the textile are not fixed against a separation by the row of loops of the thread.

From the German patent application AS 1 069 457 a chain stitch sewing machine is known which is guided by hand and which works with an arch-shaped needle.

From the U.S. Pat. No. 4,503,788 a sewing machine is known which is suitable for the sewing of complex aeroplane structures which are made from already cured fiber reinforced composite materials. This sewing machine needs a counter-hold during sewing.

In the German patent application DE-OS 195 29 984 A1 a sewing machine is described which is suitable for the production of spherical sleeves. This is a sewing machine which works with a counter-hold.

In the U.S. Pat. No. 5,458,075 a sewing machine with a mechanical decoupling and an electronic coupling of the functional parts is described. It works with a two sided approach of the textile as conventional sewing machines.

From the German patent application DE-OS 33 38 405 A1 two different sewing machines are known. One of the machines which approaches the textile from both sides produces a lock stitch. Furthermore in this document a sewing machine is shown which approaches the textile from one side and produces a chain stitch.

A sewing device with robot-guided upper and lower parts of a sewing machine is known from the German patent DE-PS 44 31 318 C2.

The method which is described in the German patent application DE 29 21 026 is known. This method leads to seams which are similar to the seams described here and produced with two needles. But this method is based on an additional machine part below the textile which is coupled with the needle mechanisms, namely a hook or a rotating hook. The device is based on the conventional sewing methods and demands machine parts on both sides of the textile. Furthermore the needles are situated in one plane and the needles move in this plane on straight lines which intersect each other in the textile.

As well known are the method and the device described in the German patent application OS 16 85 043. In this case the needles which are necessary for the generation of stitches move on two planes which are parallel to each other. Furthermore this device requires a significant phase without any movement of one of the two needles. Such phases without any movement are very difficult to control, as mechanical vibrations of the machine occur and a fast moved machine part, as it is necessary there, cannot be positioned for an extremely short time without any movement.

OBJECT OF THE INVENTION

A main task of the invention is to give a method and device of the above described kind which avoids the described disadvantages and which allows especially the sewing of textiles with large dimensions under minimized demanded space and which allows the spherical sewing.

SUMMARY OF THE INVENTION

The invention provides a method for the production of sewn seams for which all stitch and seam generating functional parts of the device are situated on only one side of the textile. The stitch and seam generating functional parts move on planes which are directed obliquely towards the textile and the textile is laid on a support unit which allows the penetration of the stitch and seam generating functional parts. According to the invention at least two loops of threads penetrate each other and all stitch and seam generating functional parts of the device are situated on only one side of the textile. The stitch and seam generating functional parts move in planes which are directed obliquely towards the textile and intersect each other with the stitch and seam generating a functional parts describing on these planes coupling curves which describe a permanent change between a principally linear and a principally rotatory movement whereby the single coupling curves possess on the other side of the textile a sufficient approach towards each other to transmit a loop of a thread from one stitch and seam generating functional part to the next stitch and seam generating functional part. Furthermore, the textile is situated on a support unit which allows the penetration of the stitch and seam generating functional parts and on which the textile is fixed by a counter-holder which is connected with the device. The device is moved over the textile in steps making use of a step-moving transport-unit which is switched electronically or mechanically by the drive shaft during the rotatory movements of the stitch and seam generating functional parts so that the stitch and seam generating functional parts rotate around an imaginary axis which lies in the textile and at the beginning of the process the device is positioned on the textile in a way that the stitch and seam generating functional parts penetrate the textile perpendicularly.

Under the prerequisite of a one-sided approach to the textile and by avoiding further stitch creating or loop creating functional parts it is possible to create a sewn seam with two or more needles in which the loop of one thread is guided through the loop of another thread. By the invention the sewing of big planes of textiles is possible under a minimized demand of space and the method is applicable for spherical sewing.

The invention allows the sewing of different materials. One typical example for an application under the condition of sewing with a one-sided approach is the sewing of reinforcing textiles for fiber reinforced composite materials. To avoid damages of this textiles it is not allowed to fold them. By connecting several layers making use of a sewing process and an impregnation of these connected textile layers with a polymer the generated fiber reinforced composite accepts much more higher loads as a fiber reinforced composite material made from non-sewn textiles. The sewing of big structures from reinforcing textiles for composites, e.g. for aeroplane parts, by making use of a conventional sewing system leads to a high demand of space volume as the textile has to be moved relatively to the sewing machine. Only the possibility to reach all areas of the textile with a moving sewing machine which approaches the textile from one side leads to a minimized demand of space.

Fiber reinforced composite materials have a laminar structure and are produced from reinforced textile materials and a matrix material. The actual fiber reinforced composite material is created only through the hardening of the matrix. If the reinforcement textiles with the matrix material are sown together with a reinforcement enhancing thread prior to the impregnation of the matrix with the hardening agent, then the disadvantages of the conventional finishing methods can be avoided. Further the fact that they are sewn together makes possible the manufacturing and combination of different reinforcement textiles, which can not be accomplished with the heretofore known finishing methods.

A drive shaft of the device can be coupled electronically with the control unit of the transport unit so that the transport unit is operated in dependence of the turning speed of the drive shaft of the device.

The geometry of the sewn seam can be given from a design program to the control unit of the transport unit in combination with a control routine which allows to change the direction of the seam.

The settings of the cranks, the distances between the cranks and the length of the needle stick and thereby the length of the stitches can be varied.

According to a feature of the invention a rotating linear guide way at a crank and a rotating fixed bearing at the crank are eccentrically supported and an additional phase displacement of the movements of the stitch and seam generating functional parts is given to set the positions of the single stitch and seam generating functional parts to each other in the phase of the loop generation of the thread and in the phase of catching the loops of the threads.

For spherical sewing a support unit for the textile is flexible in a way that spherical geometries can be generated with it, and a counter-holder of the device can be adapted to the shape of the support unit and the device can be rotated around the three axes additionally to the linear movements.

The transport unit for the advance of the device can be integrated in the device in a way that transport elements are supported on the plane of the textile to be sewn.

The transport unit for the movement of the device can be integrated in the device in a way that a manual guiding of the device is possible and thereby the sewing of tube-shaped or sleeve-shaped textiles is possible.

BRIEF DESCRIPTION OF THE INVENTION

The invention will be explained by making reference to drawing which shows a preferred embodiment.

SPECIFIC DESCRIPTION

Figure 1:
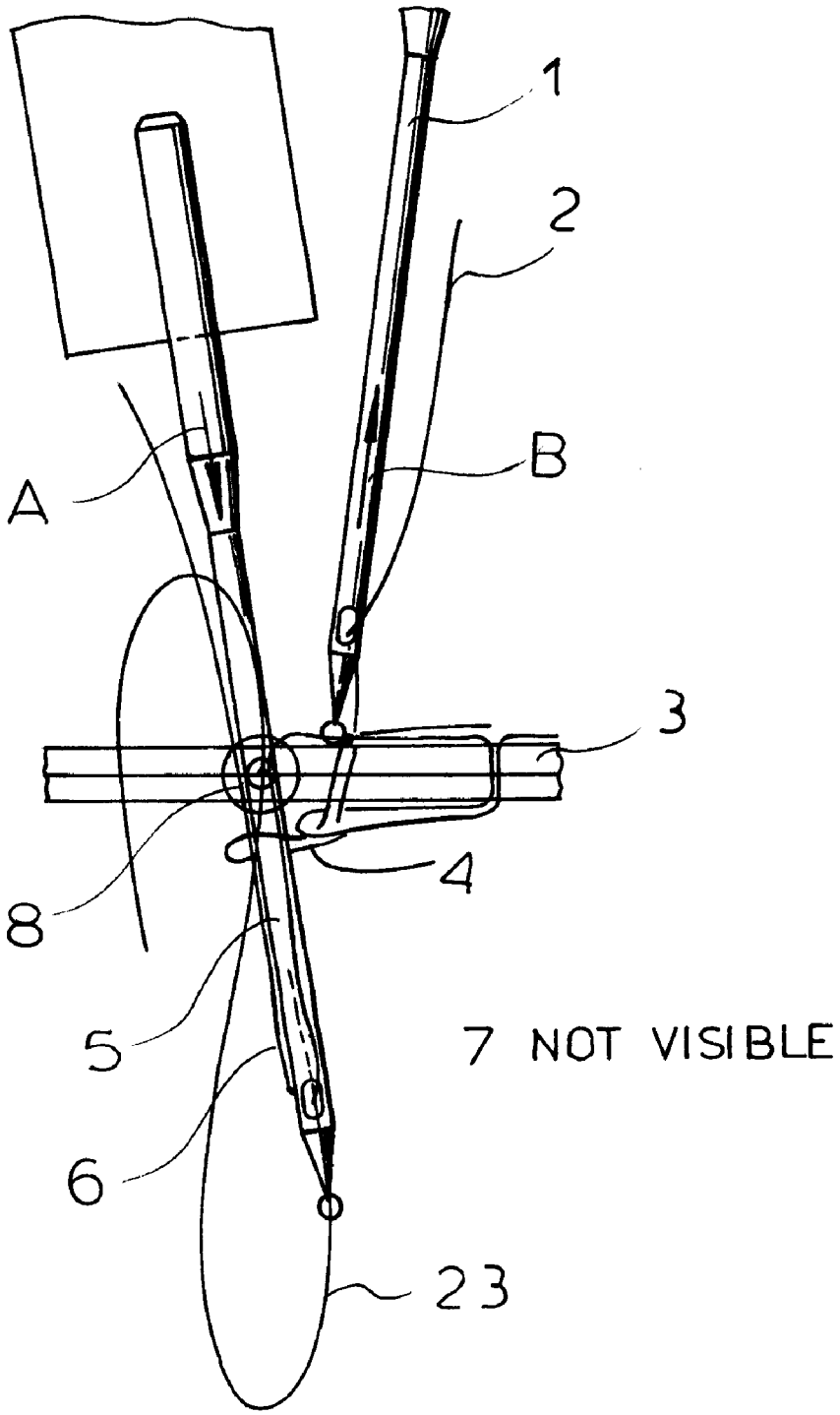
FIG. 1 is a diagram showing creation of a single stitch by the method according to the invention.

As is shown in FIG. 1, in this example a sewn seam is generated by stitching a needle 1 with a thread 2 into the textile 3. After it has reached its lower dead point a loop 4 of the thread is created. The loop 4 of the thread is penetrated by a further needle 5 with a thread 6. Both needles 1 and 5 move in two different planes which intersect one another. They move in these planes not in a linear way but describe coupling curves. As a result needle 5 penetrates the loop 4 which is created by needle 1 and thread 2. During the upward movement of needle 2 the needle 5 penetrates the textile 3 deeper. After exceeding its lower dead point needle 5 also creates with thread 6 a loop 7 which is penetrated again by needle 1 with thread 2. As the loop 7 is created at a later time it is not shown in FIG. 1. During the upward movement of needle 5 the loop 4 which is tied around needle 5 is pulled off by the textile 3. To realize this method the needles 1 and 5 describe figure eight-shaped coupling curves 23 which penetrate each other. The coupling curves 23 are designed in a way that the intersection point of each single coupling curve 23 is situated below the textile 3. This intersection point is not shown in FIG. 1 as there is already a horizontal movement of the superpositioned device. The intersection line of both movement planes is also situated below the plane of the textile. During the penetration of the textile the needles 1 and 5 are moving on nearly linear paths which are directed obliquely towards the plane of the textile 3. After this nearly linear movement of the needles 1 and 5 they describe the lower arched section of the coupling curve 23. In this time the device is moved over the textile 3, so that the sections of the needles 1 or 5 which cross the plane of the textile are rotated around an imaginary axis 8 which is perpendicular to the needles 1 or 5. Additionally the progression of the seam generation is done thereby. That means that the needles 1 and 5 move in different phases and a permanent change between a principally linear and a principally rotatory movement is accomplished.

Figure 2:
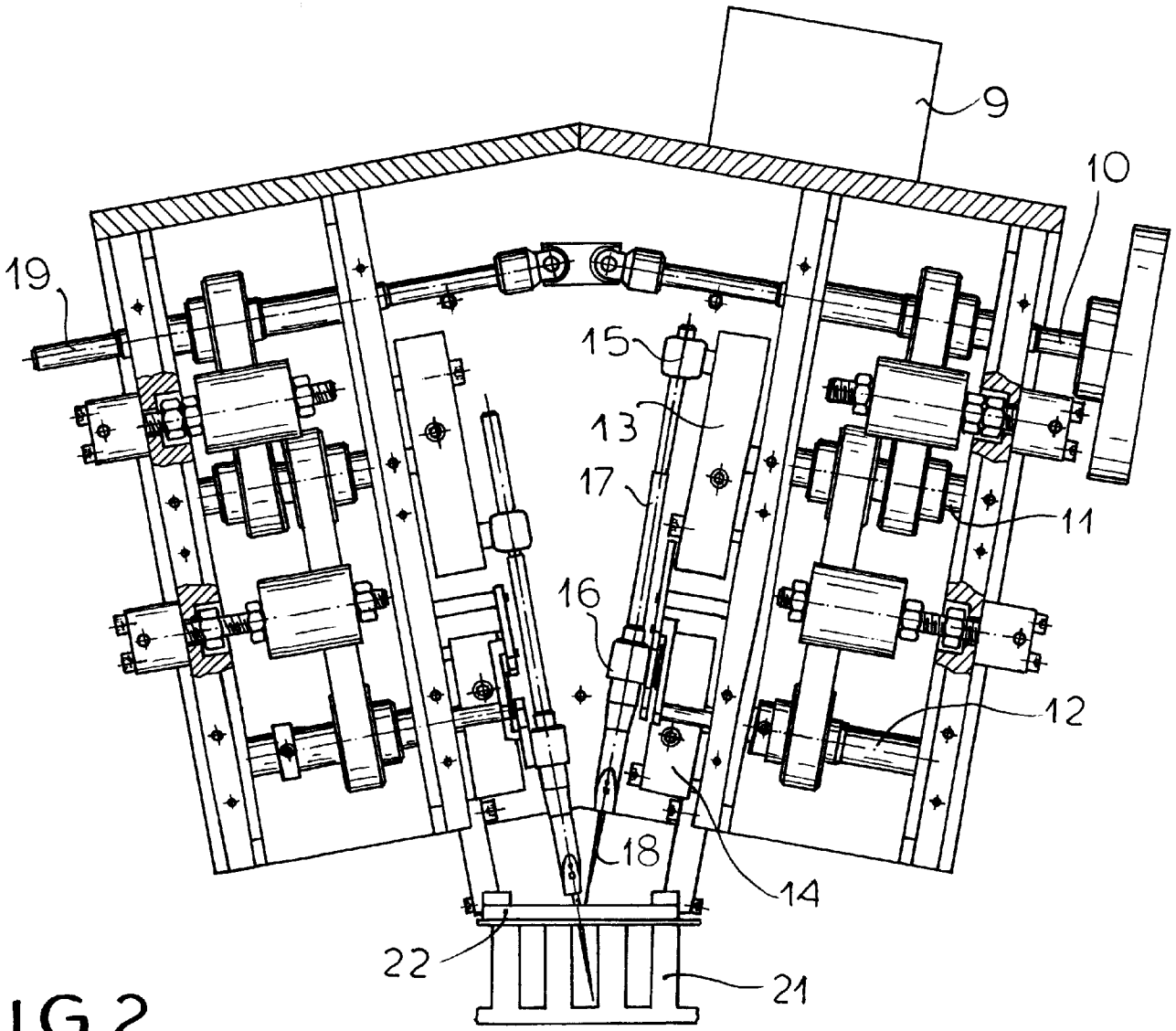
FIG. 2 is a side view of the device according to the invention.

The described movement is generated by the gear mechanisms which are shown in FIG. 2. This mechanism is described because of its simplicity, but it is possible to substitute it by at least two other gears mechanisms which might be designed following the rules of Roberts.

Figure 3:
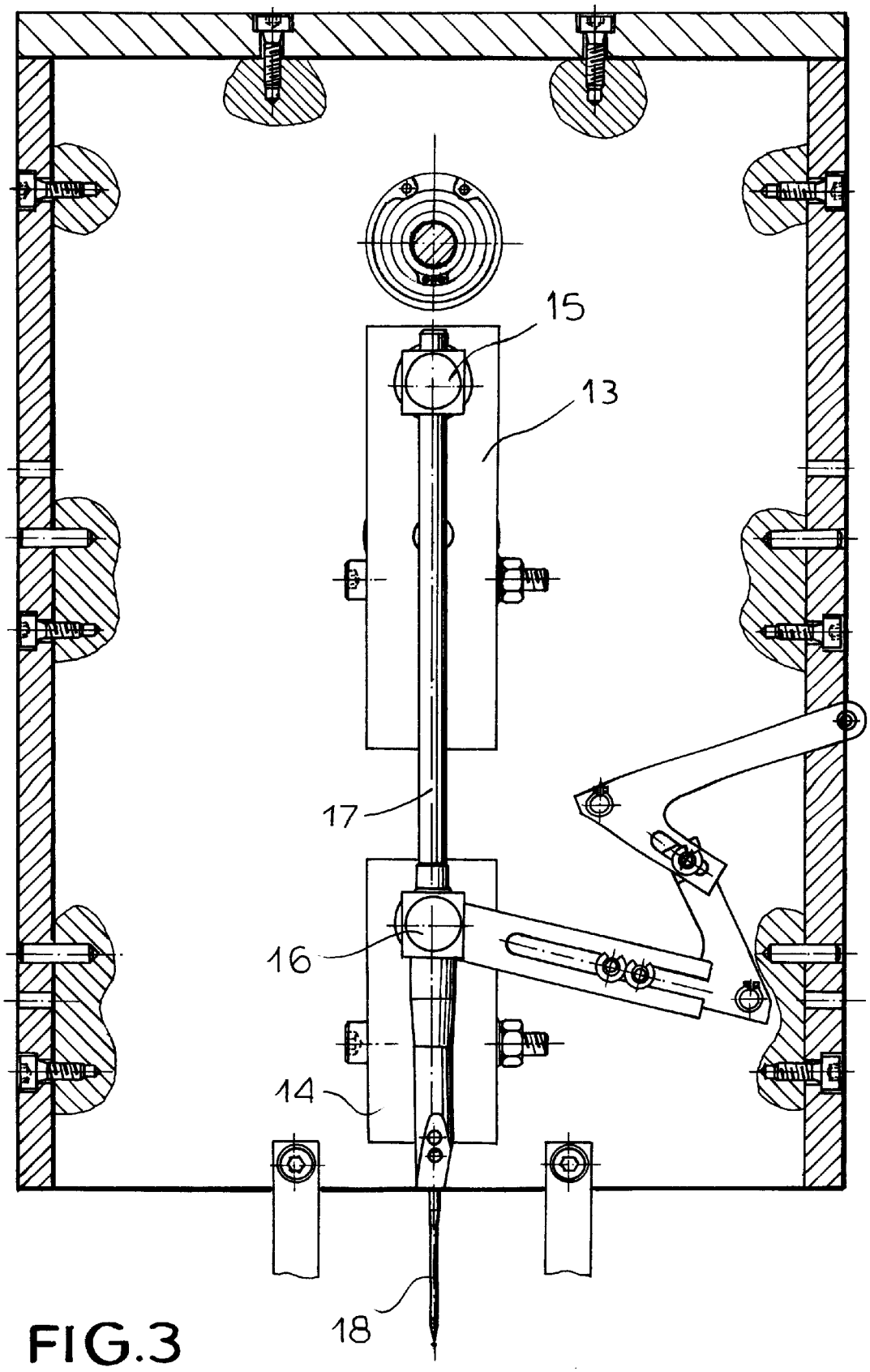
FIG. 3 is a top view of a crank mechanism.

FIG. 2 shows a side view of the device. It is possible to look at the device in two halves. The right half consists of the drive 9 with a drive shaft 10. The rotary movement of this shaft is transmitted to the shaft 11 and from there it is again transmitted to the shaft 12. At the ends of the shafts 11 and 12 are the cranks 13 and 14. At the crank 13 a rotating linear guide way 15 is situated, at the crank 14 a rotating fixed bearing 16 is situated which fixes the needle shank 17 in its axial way. By the linear guide way 15 and the fixed bearing 16 the needle shank 17 with the needle 18 is guided. (FIG. 3). By the rotary movement of the drive shaft 10 the needle 18 describes the above explained coupling curve 23 (FIG. 1). At the same time the rotary movement of the drive shaft 10 is transmitted to the shaft 19 of the left half of the device. This second half of the device is designed as the right half of the device, the cranks of the left half of the device are positioned in a way that they are shifted about a phase angle against the cranks 13 and 14.

The whole device is moved in this example by a x-y-z-mechanism 20 above the textile. The x-y-z-mechanism 20 is not shown in FIG. 2. The textile is situated on a support unit 21 which allows the penetration of a needle. The device contains in its lower part a stitch plate 22 which is used for fixing the textile on the support unit 21. The fixation is done by an adapted pressing of the device with the stitch plate on the textile 3 and the below situated support unit 21. Furthermore it is possible to rotate the device around the three axes to allow spherical sewing.

We claim:

1. A method for the production of sewn seams for which all stitch and seam generating functional parts of a sewing device are situated on only one side of a textile, said stitch and seam generating functional parts moving in planes which are directed obliquely towards the textile and the textile being laid on a support unit which allows the penetration of the stitch and seam generating functional parts, said method comprising causing at least two loops of threads to penetrate one another and such that all stitch and seam generating functional parts of the device are situated on only one side of the textile, said stitch and seam generating functional parts moving in planes directed obliquely towards the textile and intersecting each other and the stitch and seam generating functional parts describing in said planes respective individual coupling curves which describe a permanent change between a principally linear and a principally rotatory movement whereby the individual coupling curves possess on the other side of the textile a sufficient approach towards each other to transmit a loop of a thread from one stitch and seam generating functional part to a next stitch and seam generating functional part, said support unit permitting the penetration of the stitch and seam generating functional parts and the textile being fixed by a counter-holder on said support unit, whereby said device being moved over the textile in steps making use of a step-moving transport unit which is switched electronically or mechanically by a drive shaft during rotatory movements of the stitch and seam generating functional parts so that the stitch and seam generating functional parts rotate around an imaginary axis which lies in the textile and at a beginning of the process the device is positioned on the textile in a way that the stitch and seam generating functional parts penetrate the textile in perpendicularly.

2. The method according to claim 1 wherein the drive shaft is coupled electronically with a control unit of the transport unit so that the transport unit is operated in dependence on a turning speed of the drive shaft of the device.

3. The method according to claim 2 wherein the geometry of the sewn seam is given from a design program of the control unit of the transport unit in combination with a control routine which allows change in a direction of the seam.

4. The method according to claim 1 wherein the stitch and seam functional parts have cranks and needle shanks, the settings of the cranks, the distances between the cranks and the length of the needle shanks and thereby the length of the stitches can be varied.

5. A device for producing a sewn seam in a textile, comprising:

a pair of needle shanks carrying respective needles adapted to penetrate through said textile from one side thereof, said needles carrying respective threads and said shanks being movable in respective planes which are directed obliquely toward said textile and intersecting one another;

a drive mechanism operatively connected to said needle shanks for imparting a figure 8 movement to the respective needles in the respective planes thereby forming respective individual coupling curves including permanent changes between principally linear and principally rotary movements whereby the individual coupling curves possesses on the other side of the textile a sufficient approach toward each other to transmit a loop of a thread from one underside to the other, said mechanism including respective cranks, rotating linear guide ways for said shanks at the respective crank and respective rotating fixed bearings; and a support unit carrying said textile and permitting the penetration of the needles, said support unit having a counter-holder engaging the textile, the rotating linear guide way at the crank and the rotating fixed bearing at the crank being eccentrically supported and an additional phase displacement of the movements of the needles is given to set the positions of the needles to each other in a phase of the loop generation of the threads and in a phase of catching the loops of the threads.

6. The device according to claim 5 wherein for a spherical sewing the support unit for the textile is flexible in a way that spherical geometries can be generated with it, and the counter-holder of the device can be adapted to the shape of the support unit and the device can be rotated around the three axes additionally to the linear movements.

7. The device according to claim 5, further comprising a transport unit for the advance of the device integrated in the device in a way that transport elements are supported on the plane of the textile respectively the textile to be sewn.

8. The device according to claim 7 wherein the transport unit is integrated in the device in a way that a manual guiding of the device is possible and thereby the sewing of tube-shaped or sleeve-shaped textiles is possible.

* * * * *